US008661734B2

(12) United States Patent
Kernaghan et al.

(10) Patent No.: US 8,661,734 B2
(45) Date of Patent: Mar. 4, 2014

(54) WINDOW ASSEMBLY WITH A SLIDING MEMBER AND A SECURITY MEMBER HAVING A VENTILATION PORTION

(75) Inventors: Ian Kernaghan, Nottinghamshire (GB); Kevin Gorman, Cheshire (GB)

(73) Assignees: Britplas Commercial Windows Limited, Warrington (GB); Eurocell Profiles Limited, Derby (GB)

( * ) Notice: Subject to any disclaimer, the term of this patent is extended or adjusted under 35 U.S.C. 154(b) by 727 days.

(21) Appl. No.: 12/294,705

(22) PCT Filed: Mar. 28, 2007

(86) PCT No.: PCT/GB2007/001127

§ 371 (c)(1),
(2), (4) Date: Jul. 7, 2009

(87) PCT Pub. No.: WO2007/110641

PCT Pub. Date: Oct. 4, 2007

(65) Prior Publication Data

US 2010/0180504 A1 Jul. 22, 2010

(30) Foreign Application Priority Data

Mar. 28, 2006 (GB) ..... 0606152.7

(51) Int. Cl.
*E06B 3/44* (2006.01)

(52) U.S. Cl.
USPC ..... 49/125; 49/50; 49/56; 49/57; 49/62; 49/63

(58) Field of Classification Search
USPC ..... 49/50, 56, 61–63, 57, 125, 501
See application file for complete search history.

(56) References Cited

U.S. PATENT DOCUMENTS

| | | | | |
|---|---|---|---|---|
| 157,085 | A * | 11/1874 | Tatum | 49/50 |
| 2,202,685 | A * | 5/1940 | Bayley | 52/204.51 |
| 2,494,161 | A | 1/1950 | Blackman | |
| 2,842,236 | A | 7/1958 | Axelrod | |
| 2,869,187 | A * | 1/1959 | Liebman et al. | 52/207 |
| 4,074,483 | A * | 2/1978 | Vickstrom | 52/202 |
| 4,262,450 | A | 4/1981 | Anderson | |
| 4,330,020 | A | 5/1982 | Glynn | |
| 4,483,099 | A | 11/1984 | Schmidt | |
| 4,662,038 | A * | 5/1987 | Walker | 24/460 |
| 5,435,781 | A | 7/1995 | Kitchens | |
| 6,125,910 | A * | 10/2000 | Pepperell et al. | 160/371 |
| 6,213,187 | B1 | 4/2001 | Hughes | |
| 6,263,949 | B1 * | 7/2001 | Guthrie, Jr. | 160/380 |
| 6,378,267 | B1 * | 4/2002 | Bass | 52/656.7 |
| 6,505,669 | B2 * | 1/2003 | Lilie et al. | 160/371 |
| 7,827,734 | B2 * | 11/2010 | Cox et al. | 49/63 |
| 2004/0118528 | A1 * | 6/2004 | Kovach et al. | 160/168.1 P |
| 2009/0064588 | A1 * | 3/2009 | Reid | 49/50 |

* cited by examiner

*Primary Examiner* — Katherine Mitchell
*Assistant Examiner* — Marcus Menezes
(74) *Attorney, Agent, or Firm* — Notaro, Michalos & Zaccaria P.C.

(57) ABSTRACT

A window assembly (30) comprising a frame (36) in which are received sliding and security members. The security member has ventilating and non-ventilating parts (40, 32), with the sliding member (34) being slidably moveable over the security member between a first position in which air may pass through the ventilating part (40) so as to ventilate the room in which the window assembly (30) is located, and a second position in which no such ventilation can occur. The ventilating part 40 may comprise a grille, perforated sheet, lattice arrangement or the like.

28 Claims, 3 Drawing Sheets

WINDOW ASSEMBLY WITH A SLIDING MEMBER AND A SECURITY MEMBER HAVING A VENTILATION PORTION

The present invention relates to a window assembly.

BACKGROUND OF THE INVENTION (1) Field of the Invention

Many windows for residential and commercial buildings include opening sections to allow air from an exterior of the building to enter the building, for ventilation purposes, for example. The opening sections often comprise a window pane which slides, in generally horizontal or vertical directions, in relation to a fixed pane. The panes are typically mounted in a window frame with the sliding pane being spaced from, but generally parallel to, the fixed pane, such that when the sliding pane has been moved to its open position, it is located behind the fixed pane, i.e. towards the interior of the building. Whilst windows of this nature allow a large amount of external air to enter a building, they also give rise to a number of disadvantages, principally relating to safety and security. It will be appreciated that, with the sliding pane in its fully open position, a large opening is presented, through which a person might be able to pass. This has clear security implications, in that an intruder could gain access to a building through the open window, especially where the window is at a relatively low, accessible level. Of equal importance, particularly where the windows are installed in a residential building, is the risk that a person or animal could fall or climb out of the open window, possibly leading to injury or even death.

Of course, these considerations apply not only to sliding windows, but also to doors which use the same principles of operation, such as sliding patio doors. It will be understood, in that light, that the term 'window assembly' as used herein is also intended to refer to, and thus encompass, patio door assemblies and the like.

Efforts have been made to address some of these drawbacks, but have hitherto proved unsatisfactory, with many employing guards of wire mesh or similar material which are simply positioned over a window opening.

(2) Description of Related Art Including Information Disclosed Under 37 CRF 1.97 and 1.98

For example, UK patent application no. 2378475 discloses a removable window guard comprising a frame which supports wire mesh and which can be clipped into place on an interior side of the window by means of clips which are attached to the frame.

Similarly, European patent application no. 0422934 discloses a window guard comprising a sheet of perforated metal attached to a frame which is receivable on an external side of a window frame and which can be fixed into position using brackets.

BRIEF SUMMARY OF THE INVENTION

According to a first aspect of the invention, there is provided a window assembly comprising a frame in which are received sliding and security members, the security member having ventilating and non-ventilating parts, with the sliding member being slidably moveable over the security member between a first position in which air may pass through the ventilating part so as to ventilate the room in which the window assembly is located, and a second position in which no such ventilation can occur.

The ventilating part of the security member may comprise a perforated or apertured sheet, panel, board or the like. Preferably, the ventilating part comprises a sheet, panel or layer of mesh, grille, lattice or the like.

The ventilating part may be any thickness dependent upon the proposed usage. Most preferably, the ventilating part is at least 1.5 mm thick.

Most preferably, the ventilating part comprises a sheet of metal mesh. The non-ventilating part of the security member may comprise a fixed pane.

The security member may have sealing parts to assist in holding the ventilating part in place. The ventilating part may be received within a sub-frame of the security member, with the fixed pane being received within an adjacent sub-frame.

The sealing parts may be provided within the sub-frame of the ventilating part, and may define a gap in said sub-frame within which the ventilating part is received.

The ventilating part may comprise a sheet, having a lip which is received in the gap in the sub-frame.

The ventilating part may be held in place by a fastening element which passes through it and into the sub-frame.

The fastening element may comprise a threaded fastener, and may conveniently comprise an anti-tamper screw.

There may be provided a plurality of said fastening elements.

The window assembly may comprise a concealing clip which, in use, at least partially conceals at least some of the fastening elements.

The concealing clip may be generally L-shaped in cross-section, and may have longer and shorter legs. The legs may be angularly spaced by more than 90 degrees.

The concealing clip may have a bead at the distal end of the shorter leg. The bead, in use, may engage an inner surface of the lip.

The concealing clip, in use, may cover some or all of the heads of the fastening elements.

There may be provided a formation on the sealing parts of the sub-frame which impedes removal or disengagement of the concealing clip.

The formation may project inwardly, and may be resilient, to allow the clip to pass over it during its installation in the sub-frame. Several such formations may be provided.

A remote control mechanism may be provided to operate the opening/closing of the ventilating part by controlling the movement of the sliding member over ventilating and non-ventilating parts of the security member. The remote control mechanism may be provided at an inner or an outer location of the assembly for internal/external opening/closing control respectively. The remote control mechanism may be mechanical or electrical. The remote control mechanism may be provided internally or externally of the sliding member. According to a second aspect of the invention, there is provided a concealing clip for use when holding a panel in place within a window or door frame, the concealing clip being generally L-shaped and having longer and shorter legs, the legs being angularly spaced by more than 90 degrees, such that the clip, in use, may be positioned over a fastening element which holds the panel to the frame.

The concealing clip may comprise a bead at the distal end of the shorter leg. The bead, in use, may engage an interior part of a lip of the panel.

BRIEF DESCRIPTION OF THE SEVERAL VIEWS OF THE DRAWINGS

Specific and non-limiting embodiments of the invention will now be described, strictly by way of example only, with reference to the accompanying drawings, of which.

DETAILED DESCRIPTION OF THE INVENTION

Figure 1:
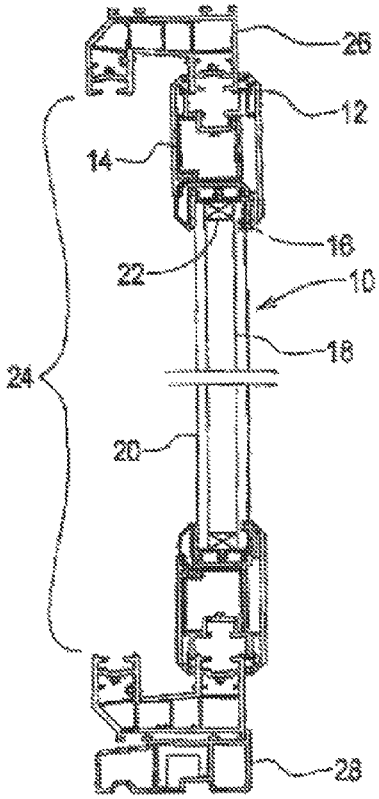
FIG. 1 (PRIOR ART)
FIG. 1 is a vertical cross-sectional view of a conventional uPVC style double-glazed fixed window pane assembly.

Referring first to FIG. 1, a conventional uPVC (unplasticised polyvinyl chloride) style double-glazed fixed window pane assembly is shown generally at 10, comprising sub-frame members 12 having internal reinforcing members 14 of aluminium, steel or any other suitable material. The sub-frame members 12 have sealing parts 16 which engage with outer and inner glass panes 18, 20, with the panes 18, 20 being separated by spacers 22 of rubber or similar material, so as to maintain an air gap between them to provide thermal and sonic insulation. Thus, the sub-frame members 12, the outer and inner panes 18, 20 and the spacers 22 form a single sealed unit 24. The sub-frame members 12 engage with a frame surround 26, which in turn engages with a wall engaging member 28 which is installed in an exterior wall of a building, to fix the sealed unit 24 into the wall. The frame surround 26 may also engage with the surround of another similar assembly 10 (not shown), or with that of a different type of assembly, such as a sliding pane assembly.

Figure 2:
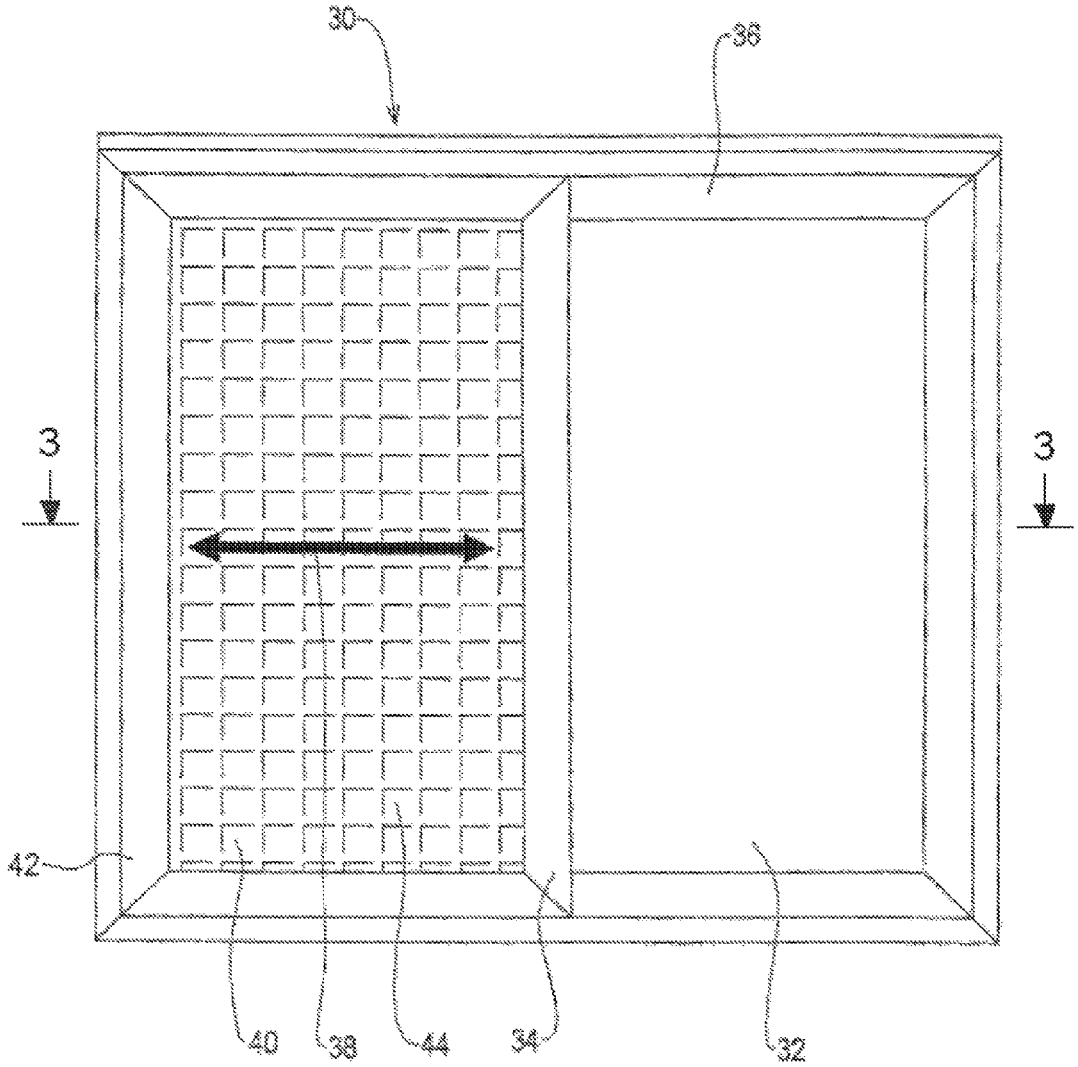
FIG. 2 is a schematic illustration of a security window assembly.

FIG. 2 is a schematic view of a security window assembly 30 in a closed condition. The security window assembly 30 comprises an outer fixed pane 32 and an inner sliding pane 34, each of generally similar construction to the sealed unit 24 referred to above. The outer fixed pane 32 and the inner sliding pane 34 are mounted within a common frame 36, with the inner sliding pane 34 being mounted for sliding movement in the direction of arrow 38, for example on rails or runners (not shown), inwardly of the fixed pane.

The frame 36 may be a plastics (e.g. uPVC), timber or metallic (e.g. aluminium) construction. The arrangement is such that the when the assembly 30 is installed, the inner sliding plane 34 lies in a generally vertical plane on an interior side of the assembly 30, with the outer fixed plane 32 lying in a generally parallel plane on an exterior side of the assembly 30. The outer fixed pane 32 and the inner sliding pane 34 can be in reverse order where opening is intended to be operated from a location external to a room in which the assembly 30 is installed.

The inner sliding pane 34 is moveable between an open position, in which it is positioned behind the outer fixed pane 32, and the closed position shown in the Figure. The rails or runners on which the sliding pane 34 is mounted, provide an inertia bearing or other suitable feature, that prevents the sliding pane 34 from being slidably moved at speed. Therefore, where the sliding pane 34 is slidably moved across said runners above a certain speed, the bearings respond by locking the position of the sliding pane 34, the aim being to prevent the sliding pane 34 from being used to self-harm or create a disturbance.

The frame 36 may be of a generally welded or mechanically jointed construction, as may be the sub-frame members 42 and 48, referred to below.

An outer security pane 40 is mounted adjacent the outer fixed pane 32, with the security pane 40 and the fixed pane 32 thus forming a single security member on the exterior side of the assembly 30. The outer security pane 40 comprises sub-frame members 42, within which a ventilating part 44, comprising a panel of wire mesh, perforated metal, lattice, grille or the like, is housed, to allow the passage of light and air but to present a physical barrier to prevent people or objects from passing through (or from being passed through, in the case of weapons or drugs, for example) the opening created when the inner sliding pane 34 is in its open condition.

The outer security pane 40 comprises approximately between 35% and 55% open area for ventilation.

In one embodiment, the outer security pane 40 comprises 2 mm perforations or apertures in a 3 mm matrix arrangement (in every 3 mm area, a 2 mm hole is provided), giving a 40% open area for visibility therethrough. This arrangement prevents the passage of very small articles and behaves as an efficient insect screen, whilst providing adequate visibility and a high degree of strength.

Where a greater degree of visibility is required, the outer security pane 40 comprises approximately 51% open area for ventilation, which is achieved by 3 mm perforations or apertures in a 4 mm matrix arrangement for optimum visibility and optimum strength. However, any suitable matrix arrangement can be provided to achieve the required degree of strength and visibility.

The outer security pane 40 is approximately 1.5 mm in most cases, although thicker and thinner panes 40 can be provided where strength is a greater issue/lesser issue respectively.

Figure 3:
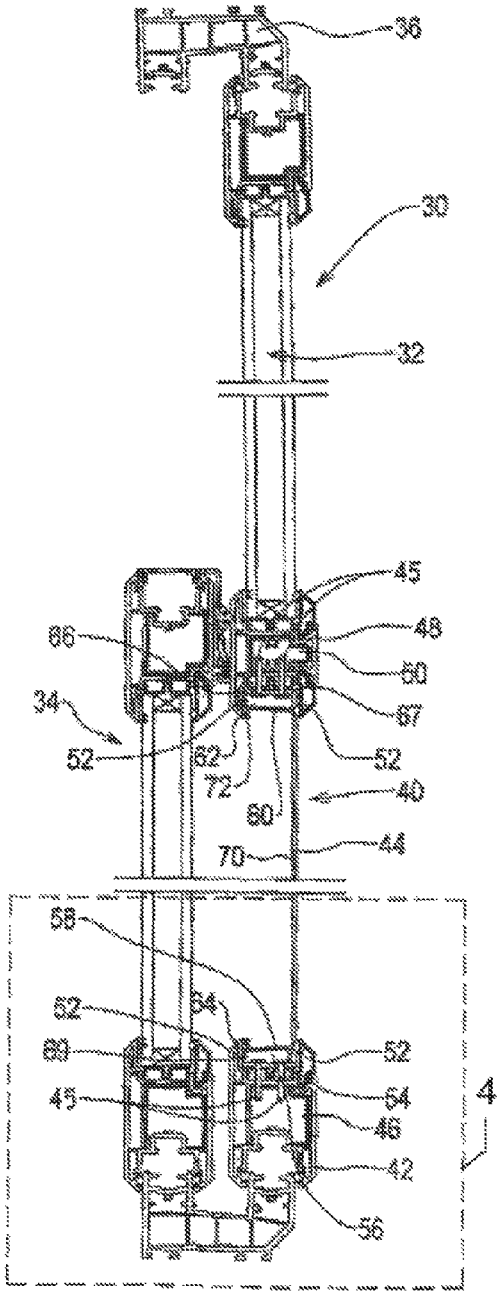
FIG. 3 is a horizontal cross-sectional view of the security window assembly taken along the line 3-3 of FIG. 2.

The construction of the outer security pane 40 is shown in more detail in FIG. 3, a horizontal cross-sectional view of the assembly 30 of FIG. 2. The outer security pane 40 has, at one side, a sub-frame member 42 with a reinforcing member 46, whilst at an opposite side the outer security pane 40 shares a sub-frame member 48 and reinforcing member 50 with the outer fixed pane 32. The sub-frame members 42, 48 have sealing parts 52, which assist in holding the ventilating part 44 of mesh or the like in place.

The ventilating part 44 comprises a generally flat sheet whose edges are folded to create a lip 54 of substantially the same depth as a gap 56 between opposed sealing parts 52 of the frame member 42. The ventilating part 44 slots into the sub-frame member 42, with the lip 54 being received in the gap 56, such that the ventilating part 44 abuts the outer sealing parts 52 of the sub-frame members 42, 48. In a preferred embodiment, the ventilating part 44 is held in place by fastening elements which pass through it, to and into the sub-frame members 42 and 48. Thus the ventilating part 44 may be held in place using threaded fasteners 45 which pass through pre-drilled holes in the lip 54 into the inner surface 67 of the sub-frames. These pre-drilled holes can be provided at regular intervals of approximately 100 mm. The threaded fasteners 45, in a preferred embodiment, may be "anti-tamper" screws, which resist unauthorised removal by virtue of a specially-configured head, for example. Where a lower degree of security is acceptable, the ventilating part 44 may simply be held in place by way of a conventional glazing bead applied to the outwardly-facing part of the assembly.

Figure 4:
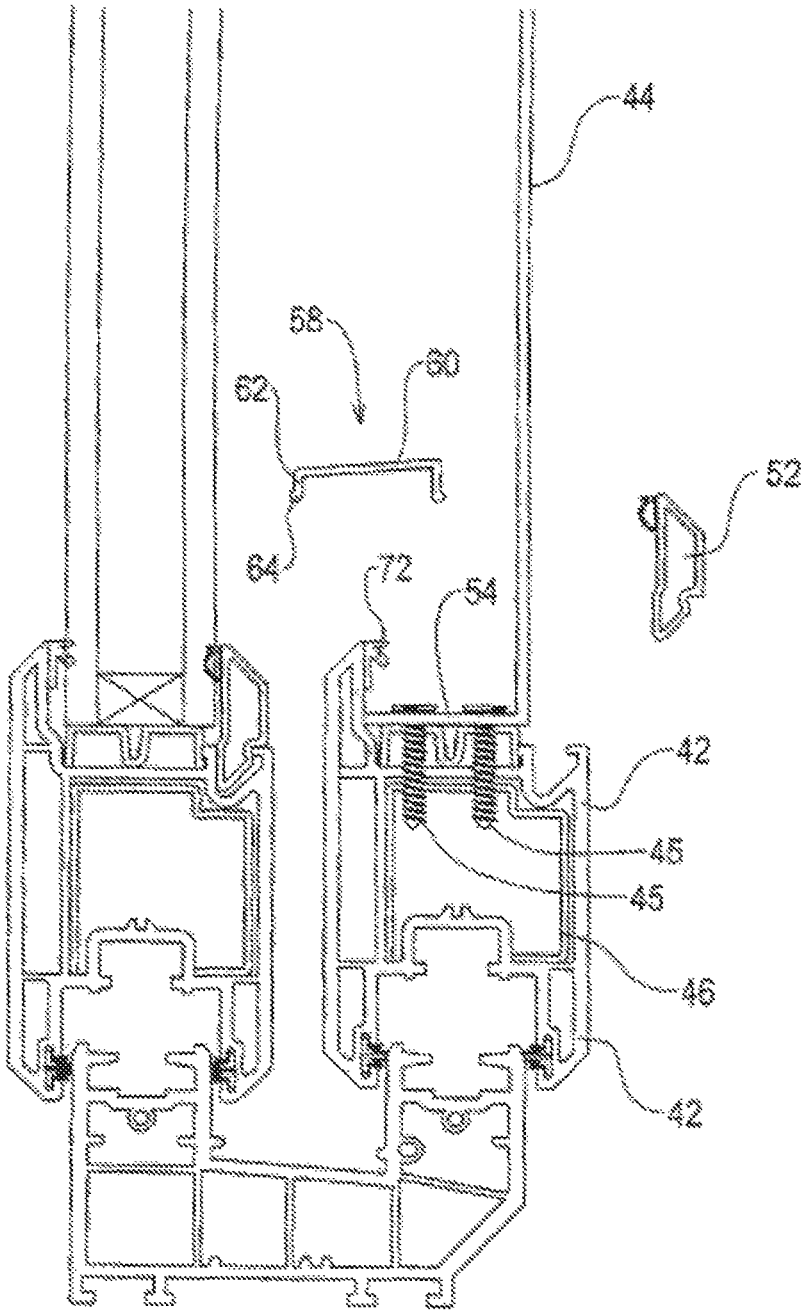
FIG. 4 is an enlarged cross-sectional view of the part of the assembly shown in the dotted outline marked 4 in FIG. 3, with some parts shown spaced from their in-use positions, for clarity.

The ventilating part 44 may also be provided with a concealing clip, shown generally at 58 in FIGS. 3 and 4. One or more individual clips 58 may be provided, with the clips 58 being spaced at intervals along the length of the lip 54, over the threaded fasteners 45 which hold the ventilating part 44 in place. In a preferred embodiment, however, a single elongate clip 58 is used, extending along substantially the entire length of the lip 54, so as to ensure a close fit between the ventilating part 44 and the sub-frame members 42, 48.

The concealing clip 58 is generally L-shaped in cross-section, extruded or otherwise formed of uPVC, aluminium or any other suitable material, and comprises longer and shorter legs 60, 62, with the legs 60, 62 being angularly spaced by slightly more than 90 degrees. A bead 64 is formed at the distal end of the shorter leg 62.

To install the clip 58, the bead 64 is brought into engagement with an interior part 66 of the lip 54, at a free end of the lip 54, with the lip 54 being in an abutting relationship with the first inner surface 67 of the sub-frame member 42, 48. The clip 58 is then rotated about the bead 64 such that the free end of the longer leg 60 comes into engagement with an inner face 70 of the ventilating part 44, with the ventilating part 44 being in an abutting relationship with a second inner surface of the sub-frame members 42, 48. The clip 58 may be installed before or after the sealing parts 52 of the sub-frame members 42, 48.

The purpose of the concealing clips 58 is partly aesthetic, in that they cover the heads of the threaded fasteners 45 referred to above, but also functional, in that they make unauthorised removal of the ventilating part 44 more difficult by concealing the location of the fasteners. To maximise the security benefits, it will be understood that the use of a single elongate clip 58, extending substantially along the entire length of the lip 54, will be preferable. The clip 58 may alternatively or additionally be retained in position by way of an adhesive, silicone sealant or the like.

Inwardly projecting formations 72 such as spurs or barbs are provided on the inner sealing parts 52 of the sub-frame members 42, 48, and project into the gap 56, to impede removal or disengagement of the clip 58. The inwardly projecting formations 72 may be resilient, so as to allow the clip 58 to pass over them during its installation.

It will be appreciated that the ventilating part 44 is not easily removable, as it is attached internally of the sub-frame members 42, 48, by means of the sealing parts 52 and the threaded fasteners 45 referred to above. Thus, the security window arrangement 30 described above provides improved safety and security, whilst also allowing light and air into a room. Although the arrangement has been described as a security window arrangement, it is clear that it is equally suitable for use in other openings, such as doorways. Equally, although the arrangement has been described in relation to a generally horizontally opening window, it will be appreciated that it is equally applicable to generally vertically sliding windows, such as sash windows or the like.

It should also be noted, of course, that the externally-beaded arrangement shown in FIG. 3 is only exemplary, and that an internally-applied glazing bead could equally well be used.

In one embodiment of the invention, a remote control mechanism is provided for opening/closing of the internal sliding pane 34. The remote control mechanism is provided internally of the sliding pane 34 where required. However, the mechanism can be provided externally of the sliding pane 34 where a greater degree of security over the opening/closing of the sliding pane 34 is necessary. In this latter case, the sliding pane 34 would not be manually slidable. For, example, the control can be provided on an outer side of the security pane 40 to be inaccessible from the inside, or on an inner side of the security and sliding internal pane 34 to be accessible from the inside, which can depend upon the intended use of the window assembly.

In a preferred embodiment, the remote control mechanism comprises a motor. Alternatively, a pulley system or any other suitable system can be employed, which can be operated mechanically or electrically. When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof. It is of course to be understood that the invention is not intended to be restricted to the details of the above embodiments, which are described by way of example only. Thus, it is to be understood that the window assembly could be used as a patio door type arrangement. In addition, where greater/lesser degrees of security are required, alternative percentage open areas can be applied to the ventilating part 44.

The invention claimed is:

1. A window assembly comprising a frame in which are received sliding and security members, the security member having a ventilating part received within a first sub-frame and a non-ventilating part received within a second sub-frame, with the sliding member being slidably moveable over the security member between a first position in which air may pass through the ventilating part, so as to ventilate the room in which the window assembly is located, and a second position in which no such ventilation can occur, wherein the ventilating part is received within a pair of opposed inwardly facing gaps in the first sub-frame which both open towards each other out onto a first common plane, the non-ventilating part is received within a pair of opposed inwardly facing gaps in the second sub-frame which both open towards each other out onto a second common plane, and said inwardly facing gaps in the first and second sub-frames are of substantially the same width;

wherein said inwardly facing gaps are each defined by at least a bottom and two opposed spaced apart legs, wherein the opposed spaced apart legs forming each gap extend approximately the same distance from the bottom of the gap, and wherein the opposed spaced apart legs are substantially parallel to each other and also to the common plane onto which the gap opens; and a concealing clip extending between one of the opposed legs defining each inwardly facing gap in the first sub-frame and the ventilating part.

2. A window assembly according to claim 1, wherein the ventilating part of the security member comprises a perforated sheet, panel, or board.

3. A window assembly according to claim 1, wherein the ventilating part comprises a sheet, panel or layer of mesh, grille, or lattice.

4. A window assembly according to claim 1, wherein the ventilating part comprises a sheet of metal mesh.

5. A window assembly according to claim 1, wherein the non-ventilating part of the security member comprises a fixed pane.

6. A window assembly according to claim 1, wherein the first and second sub-frames are adjacent each other.

7. A window assembly according to claim 6, wherein the security member comprises sealing legs to assist in holding the ventilating part in place, the sealing legs are provided within the first sub-frame and define the inwardly-facing gap in the first sub-frame within which the ventilating part is received.

8. A window assembly according to claim 1, wherein the concealing clip is generally L-shaped in cross-section, and has longer and shorter legs.

9. A window assembly according to claim 8, wherein the concealing clip has a bead at an end of the shorter leg.

10. A window assembly according to claim 9, wherein the ventilating part comprises a sheet having a lip and the bead engages an inner surface of the lip of the sheet of the ventilation part.

11. A window assembly according to claim 1, wherein the security member comprises sealing legs provided on the first sub-frame of the ventilating part to assist in holding the ventilating part in place and a formation is provided on one of the sealing legs of the first sub-frame which impedes removal or disengagement of the concealing clip, wherein the sealing legs have opposed spaced apart surfaces.

12. A window assembly according to claim 11, wherein the formation projects inwardly.

13. A window assembly according to claim 1, wherein the ventilating part comprises a sheet and the inwardly-facing gap in the first sub-frame, in which the ventilating part sheet is received, is of greater width than the thickness of the ventilating part sheet.

14. A window assembly according to claim 1 wherein the sliding member is mounted for sliding movement on rails or runners.

15. A window assembly according to claim 1, wherein the ventilating part comprises a sheet, having a lip which is received in the inwardly facing gap in the first sub-frame.

16. A window assembly according to claim 1, wherein the ventilating part comprises at least one lip extending between the opposed spaced apart legs defining the inwardly facing gaps of the first sub-frame;

wherein the ventilating part is held in place by at least one fastening element extending first through the lip and thence into the bottom of the respective gaps; and wherein the concealing clip extends between one of the opposed legs defining each inwardly facing gap in the first sub-frame and the ventilating part, the concealing clip being positioned to conceal the at least one fastening element.

17. A window assembly according to claim 16, wherein the at least one fastening element comprises a threaded fastener.

18. A window assembly according to claim 16, wherein the at least one fastening element comprises an anti-tamper screw.

19. A window assembly according to claim 1, wherein the ventilating and non-ventilating parts form a single security member.

20. A window assembly according to claim 1, wherein the first and second sub-frames have a shared sub-frame member.

21. A window assembly according to claim 20, wherein a part of the inwardly facing gaps in the first and second sub-frames are disposed in opposed legs of the shared sub-frame member.

22. A window assembly according to claim 1, wherein the inwardly facing gap in the first sub-frame is formed by a groove on an inner surface of the first sub-frame, and wherein the inwardly facing gap in the second sub-frame is formed by a groove on an inner surface of the second sub-frame.

23. A window assembly according to claim 22, wherein the groove in the first sub-frame extends substantially around the entire inner surface of the first sub-frame and wherein the groove in the second sub-frame extends substantially around the entire inner surface of the second sub-frame.

24. A window assembly according to claim 22, wherein a profile of the groove in the first sub-frame substantially matches a profile of the groove in the second sub-frame.

25. A window assembly according to claim 1, wherein the inwardly facing gaps in the first sub-frame and the inwardly facing gaps in the second sub-frame open out onto a same common plane.

26. A window assembly according to claim 1, wherein at least one inwardly facing gap is defined by a bottom, by a first spaced apart leg which is integral to the sub-frame member, and by a second spaced apart leg which can be removed from the sub-frame member.

27. A window assembly comprising a frame in which are received sliding and security members, the security member having a ventilating part received within a first sub-frame and a non-ventilating part received within a second sub-frame, with the sliding member being slidably moveable over the security member between a first position in which air may pass through the ventilating part, so as to ventilate the room in which the window assembly is located, and a second position in which no such ventilation can occur, wherein the ventilating part is received within a pair of opposed inwardly facing gaps in the first sub-frame which both open out onto a first common plane, the non-ventilating part is received within a pair of opposed inwardly facing gaps in the second sub-frame which both open out onto a second common plane, and said inwardly facing gaps in the first and second sub-frames are of substantially the same width;

wherein said inwardly facing gaps are each defined by at least a bottom and two opposed spaced apart legs, and wherein the opposed spaced apart legs are substantially parallel to each other and also to the common plane onto which the gap opens;

wherein the ventilating part comprises at least one lip positioned along the bottom of the respective gaps in the first sub-frame between the opposed spaced apart legs defining the inwardly facing gaps;

wherein the ventilating part is held in place by fastening elements extending first through a lip and thence into the bottom of the respective gaps;

wherein a concealing clip extends between one of the opposed legs defining each inwardly facing gap in the first sub-frame and the ventilating part;

wherein the inwardly facing gaps are formed by inner and outer sealing parts, wherein the outer sealing part is formed separately and is removable from the other parts of the sub-frame and includes a spaced apart leg of an inwardly facing gap; and wherein the concealing clip is positioned between the inner and outer sealing parts of the first sub-frame.

28. A window assembly according to claim 1, wherein the inwardly facing gaps in first sub-frame holding the ventilating part and in the second sub-frame holding the non-ventilating part have substantially the same cross-sectional shape and dimensions.

* * * * *